US006854203B2

(12) United States Patent
Kern et al.

(10) Patent No.: US 6,854,203 B2
(45) Date of Patent: Feb. 15, 2005

(54) COMBINATION ADVERTISING AND WARNING SIGN

(75) Inventors: Bruce R. Kern, Ponte Verde Beach, FL (US); Don Ladson, Jacksonville, FL (US); Lewis G. Libby, Jacksonville, FL (US)

(73) Assignee: Aisle Sentry, Inc., Alpharetta, GA (US)

( * ) Notice: Subject to any disclaimer, the term of this patent is extended or adjusted under 35 U.S.C. 154(b) by 0 days.

(21) Appl. No.: 10/078,055

(22) Filed: Feb. 18, 2002

(65) Prior Publication Data

US 2003/0154638 A1 Aug. 21, 2003

(51) Int. Cl.[7] ..... G09F 7/00
(52) U.S. Cl. ..... 40/492; 40/530
(58) Field of Search ..... 40/610, 530, 531, 40/533, 536, 539, 492, 124.09

(56) References Cited

U.S. PATENT DOCUMENTS

| | | | | |
|---|---|---|---|---|
| 549,618 A | * | 11/1895 | Waide | 40/585 |
| 763,603 A | | 6/1904 | Fuller | |
| 1,182,318 A | * | 5/1916 | Rose | 40/492 |
| 1,287,196 A | | 12/1918 | Black | |
| 1,513,017 A | | 10/1924 | Thornburgh | |
| 1,522,920 A | | 9/1925 | Glover | |
| 1,592,241 A | | 7/1926 | Welday | |
| 5,233,773 A | | 8/1993 | Reynolds | |
| 5,560,131 A | | 10/1996 | Gibson | |
| 5,617,661 A | | 4/1997 | Mason | |
| 5,722,623 A | | 3/1998 | Gibson | |
| 5,915,856 A | | 6/1999 | Yeranossian | |
| 6,014,828 A | | 1/2000 | Kern et al. | |

FOREIGN PATENT DOCUMENTS

| | | |
|---|---|---|
| DE | 77391 | 1/1894 |
| GB | 13073 | 4/1894 |

* cited by examiner

*Primary Examiner*—Cassandra Davis
(74) *Attorney, Agent, or Firm*—Renner, Kenner, Greive, Bobak, Taylor & Weber

(57) ABSTRACT

A combination advertising and warning sign for mounting in a retail store to display promotional materials and warn of spills and other hazardous conditions includes a housing and a movable warning arm. The housing has a front cover removably hinged to a horizontal edge of a base member. The housing can take a closed position in which the cover and base form a closed cavity concealing the warning arm. When the housing is closed, a display region for mounting the promotional material is visible at a front exterior of the cover. The housing can be opened by pivoting the cover about the hinges. When the housing is open, warning indicia are revealed and the warning arm can be pivoted horizontally to an extended position substantially perpendicular to the housing. A switch-activated audio alarm disposed within the housing cavity can also be operated.

18 Claims, 3 Drawing Sheets

COMBINATION ADVERTISING AND WARNING SIGN

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

1. Field of the Invention

This invention relates to signage, and in particular to dual purpose signage, especially designed for use in retail outlets to advertise and warn of hazardous conditions.

2. Discussion of the Prior Art

In retail outlets, such as department stores, grocery stores, drug stores and hardware stores, goods for purchase are displayed on racks and shelves, and items requiring cold storage are displayed in coolers and freezers. One common way to provide customers information about the goods being sold is to post signs on or near the displays, for example, the signs can include promotional materials about the price of the goods being sold. U.S. Pat. Nos. 5,233,733; 5,617,661; and 5,722,623 disclose various signs for use in retail stores.

One common problem, particularly apparent in grocery stores, is that hazardous conditions occur from goods falling from the display devices. One common hazard is a wet floor formed by a broken or spilled liquid container. Ordinarily, the hazard remains until a store clerk is notified and the floor is dried. This can take several minutes or more depending on the location, time of day and availability of clean-up personnel. Ideally, customers should be warned immediately of the hazard to reduce the chance of injury and limit the store owner's exposure to liability. However, in this common scenario, the customers are provided no warning of the hazard until the clerk sets up a free-standing warning device near the hazard. Such warning devices are ordinarily kept in a closet or other area of the building remote from where the goods are displayed, which prevents rapid notification of the hazard.

An improved technique is disclosed by U.S. Pat. No. 6,014,828, the contents of which are hereby incorporated by reference as though fully set forth herein. This patent discloses a dual-purpose sign adapted to be mounted to display shelving in retail stores. The sign has a vertical housing that defines a pocket concealing a pivotal arm with warning indicia. The opposite faces of the housing provide display surfaces for advertising materials. When vertical, the warning arm is completely concealed within the housing such that the sign displays only the advertisement. When a hazardous condition is present, the arm can be pulled outward and swung downwardly by gravity to a horizontal position in which the warning indicia are revealed. This sign thus provides a warning sign that is readily available in the event of a hazardous condition, but concealed during normal conditions. While this sign provides the stated improvements, it is designed for attachment to horizontal shelving making it less suited for attaching to walls and doors, and it extends principally perpendicularly to the mounting surface to display the advertisements, such that, for example, it is susceptible to being struck (and possibly damaged or knocked down) by customers passing through a store aisle.

SUMMARY OF THE INVENTION

The present invention provides a combination advertising and warning sign for mounting in a retail store to display promotional materials and warning of spills and other hazardous conditions. The sign can be converted from a closed state in which only the advertising materials are visible to an open state in which otherwise concealed warning indicia are revealed.

Specifically, the invention is a hazard warning sign with a housing and a warning extension. The housing includes a base and a cover spaced from the base to define a cavity when in a closed position. When in an open position, at least one edge of the cover is separated from the base to reveal the interior of the cavity. The warning extension is mounted within the cavity and is movable from a retracted position substantially parallel with the housing so as to be concealed by the housing when in the closed position to an extended position so as to be at an angle to the housing when in the open position.

In a preferred form, the base and cover have respective back and front panels extending substantially horizontally. Interior surfaces of these panels have additional warning indicia and the cover has an exterior surface defining a display region with a raised frame about its perimeter and having a plurality of prongs for holding advertising materials. The cover is preferably hinged to the base along a bottom horizontal edge and has pull tabs at a free edge opposite the bottom edge for opening the housing. Magnetic closures join the free edge of the cover to the corresponding edge of the base when in the closed position.

Preferably, the housing is a horizontally elongated shape and the warning extension is an elongated, horizontally-extending planar arm having opposite faces with warning indicia. The arm is preferably flexible from side to side and substantially rigid from top to bottom. The arm can be pivotally connected to the housing so as to be pivoted to an extended position substantially perpendicular to the housing when open. The sign can also include a switch-activated audio alarm disposed within the housing cavity.

Thus, the present invention provides a unique combination sign especially designed for use in retail outlets to display promotional materials and warn of spills and other hazardous conditions. In one state, the sign is a narrow horizontal signboard for holding various suitably sized advertisements, such as promotional materials for nearby products, without any visible warning indicia. In the event of a hazardous condition, the sign can be quickly opened by pulling the top edge of the cover from the base and letting the cover swing downward by gravity. When the housing is opened, multiple warning indicia are revealed, including text, graphics and eye-catching patterns and colors. An arm may also be swung about a vertical axis away from the base so that it extends at an angle to the housing. Preferably, the arm extends perpendicular to the housing so that the warning is visible to cross-traffic. The sign also includes an audio alarm that can be selectively switched on to intensify the warning provided by the sign as well as provide a warning for visually impaired persons.

The foregoing and other objects and advantages of the invention will appear from the following description. In this description reference is made to the accompanying drawings which form a part hereof and in which there is shown by way of illustration preferred embodiments of the invention. Such embodiments do not necessarily represent the full scope of the invention, however, and reference must be made therefore to the claims for determining the scope of the invention.

DETAILED DESCRIPTION OF THE PREFERRED EMBODIMENT

Figure 1:
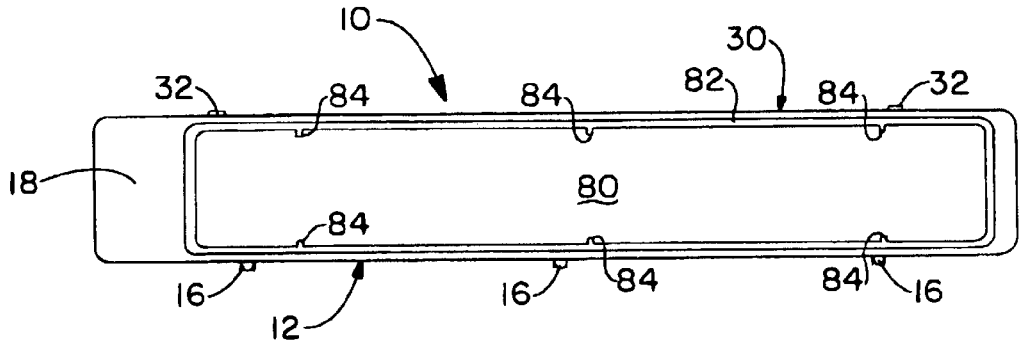
FIG. 1 is a front elevational view of the sign of the present invention shown in a closed position in which warning indicia are concealed and an advertising panel is visible.
Figure 2:
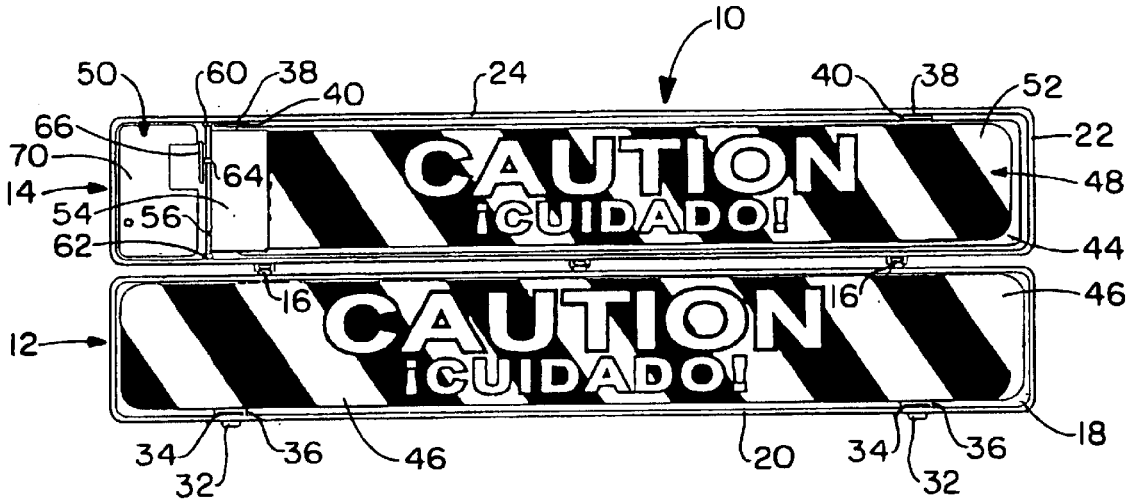
FIG. 2 is a front elevational view of the sign in an open position in which the warning indicia are revealed.
Figure 3:
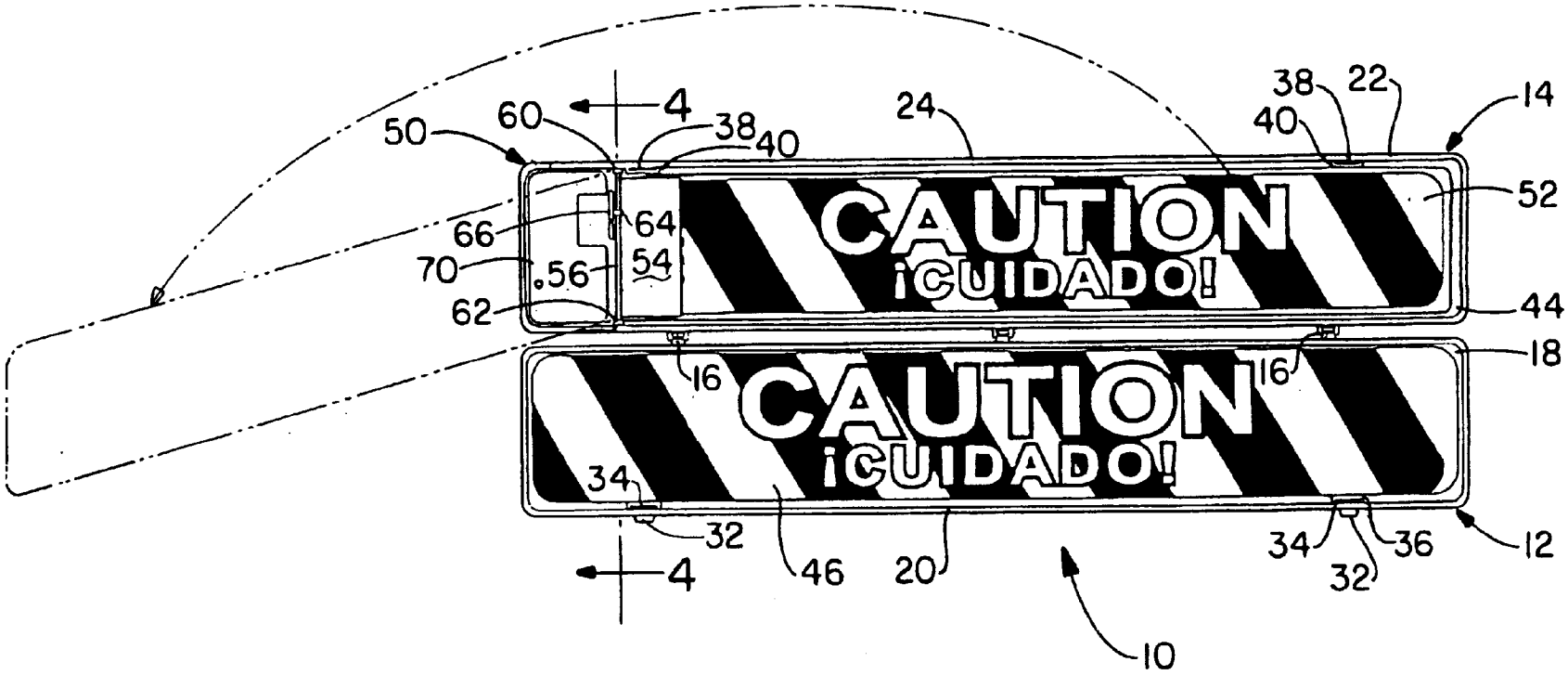
FIG. 3 is a front elevational view similar to FIG. 2 showing in phantom a swing out warning flap in an extended position.
Figure 4:
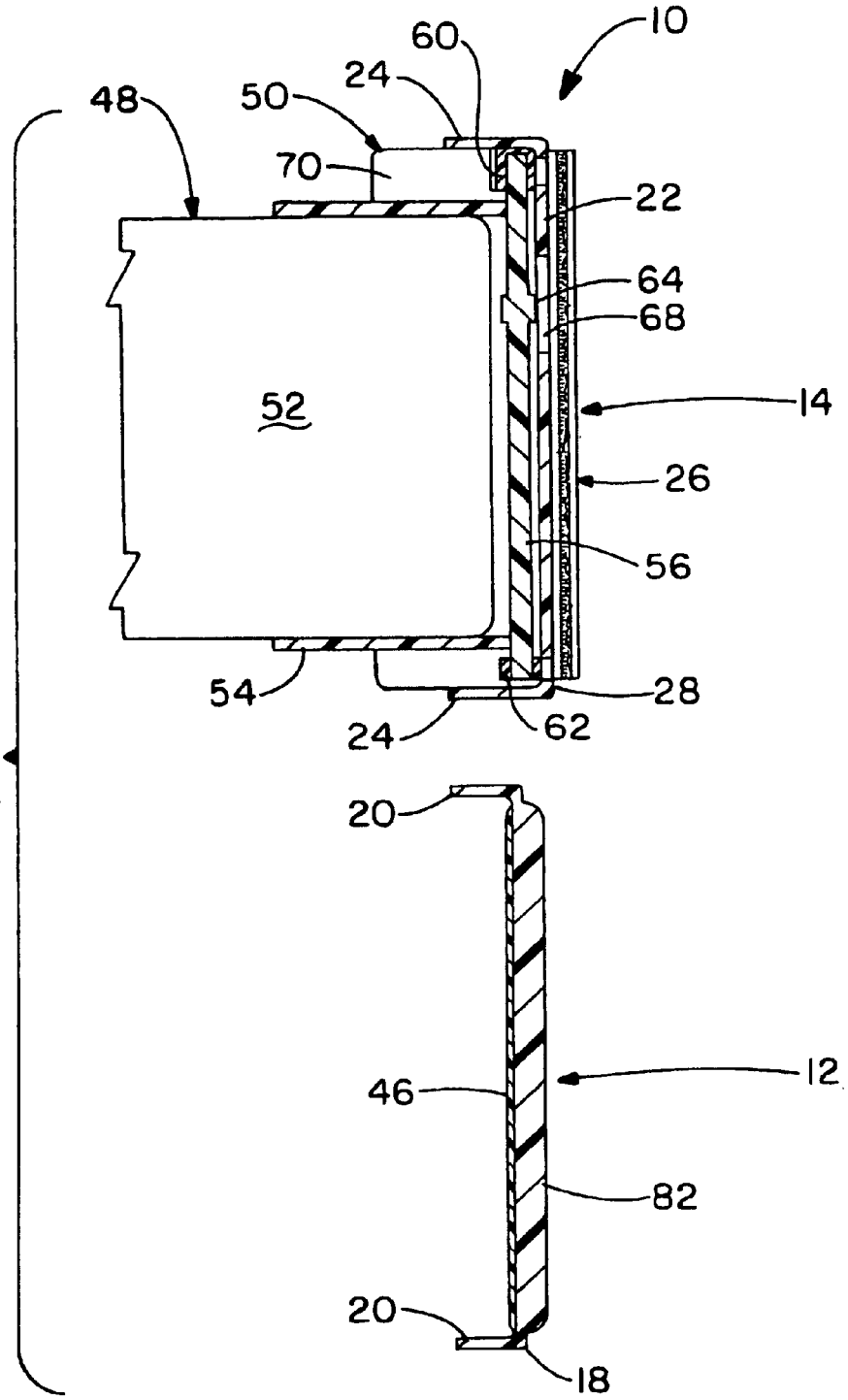
FIG. 4 is a side cross-sectional view taken along line 4—4 of FIG. 3 through the extended warning flap.

The present invention pertains to a combination advertising and warning sign designed for use in retail outlets, especially, food stores. FIG. 1 shows a sign 10 of the invention in a closed position in which the warning indicia are concealed and FIGS. 2–4 show the sign in an open position in which the warning indicia are revealed. In particular, the sign 10 has a two-piece housing structure with a swing-down cover 12 removably hinged to a base 14 by hinges 16 spaced along a bottom edge thereof so that the sign 10 can be changed from the closed position to the open position. The cover 12 and base 14 are preferably molded of a suitable plastic. The cover 12 has a planar front panel 18 with a transversely extending lip 20 around its perimeter. Similarly, the base 14 has a back panel 22 and a transverse lip 24 around its perimeter. A pair of hook and loop fasteners 26 (one shown) are adhered to a back surface 28 (see FIG. 4) of the back panel 22 for mounting the sign 10 preferably to a flat vertical surface, for example, shelving, display doors or fascia of display units.

At a free edge 30 opposite the hinges 16, the cover 12 has pulls 32 projecting upward from the lip 20. The front cover 12 is held to the base 14 at the free edge 30 by two magnetic closures including metallic plates 34 held in pockets 36 formed adjacent lip 20 near the pulls 32 and magnets 38 held in pockets 40 adjacent lip 24. Thus, with the base 14 fixed to a flat surface, the front cover 12 can be pulled away from the base 14 by gripping the pulls 32 with index fingers and pulling forward sufficiently to overcome the attractive force of the magnetic closures. The front cover 12 can thus swing downwardly under the force of gravity about the hinges 16 to the open position.

In the closed position of FIG. 1, the front 18 and back 22 panels are spaced apart the combined length of the lips 20 and 24 to form a cavity. Referring to FIGS. 2 and 3, the cavity contains warning elements, including warning decals 44 and 46, swing out warning arm 48 and alarm 50. The warning decals 44 and 46 are adhered to the interior surfaces of the front cover 12 and base 14, respectively. The decals 44 and 46 could be the same, or for example, warning decal 44 could read "Floor Hazard" in English and Spanish and warning decal 46 could read "Caution" also in bilingual format. Preferably, both include a standard eye-catching, danger-indicating color, such as red, or pattern, such as alternating diagonals of black and yellow.

Referring to FIGS. 3 and 4, the swing out warning arm 48 preferably has a flexible, flap-like plastic body 52 that can flex laterally (side to side) and is rigid longitudinally (up and down). The warning arm 48 can be struck from the side without damaging or knocking down the sign. The body 52 has flat opposite faces that are suitable to receive additional printed or decal warning indicia, for example, with the bilingual "Caution" message and warning pattern shown in the drawings. One end of the body 52 is attached to a planar extension 54 of a pivot pin 56, preferably using a suitable adhesive between the planar extension 54 and a planar back cap (not shown). The pin 56 is rotatably captured at opposite ends by upper 60 and lower 62 pivot mounts allowing the arm 48 to pivot away from the base 14. The pin 56 is formed with a raised stop 64 along its length with a flat side that abuts a transversely extending wall 66 formed in the base 14 adjacent the pin 56. The back panel 22 has an opening 68 adjacent the stop 64 that keeps the stop 64 from binding when the pin 56 is rotated. The engagement of the stop 64 and the wall 66 prevents the arm 48 from being pivoted much past perpendicular to the base 14. With the arm in this position, the sign 10 displays a warning, visible by someone standing within a full 180 degrees of the surface to which the sign is attached.

Figure 5:
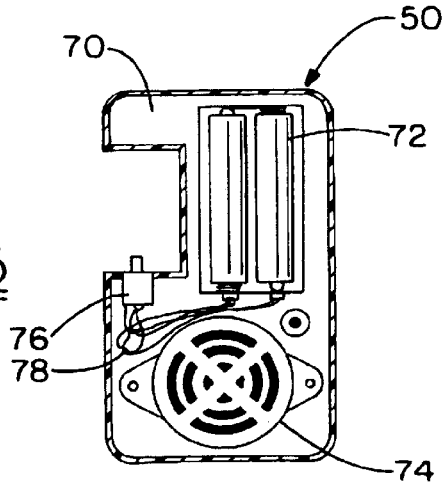
FIG. 5 is a back view of an alarm electronics compartment.

Referring to FIGS. 2 and 5, the alarm 50 is contained in a compartment 70 removably fastened to the base 14 at one end of the cavity 42. The compartment 70 houses a power supply 72, which is preferably two "AA" alkaline batteries, a speaker 74 and a normally open push button switch 76 accessible from outside the compartment 70 and coupled to the power supply 72 and speaker 74 by a pair of wires 78. The alarm 50 is activated by depressing the switch 76 to close the electrical circuit between the speaker 74 and the power supply 72. The speaker 74 preferably includes circuitry to produce a particular audio pattern, such as a repeating beep. Alternatively, or in addition, a flashing or continuously-on light could be used as the warning, and the warning system could be activated by pivoting the sign arm 48 into the warning position.

Referring again to FIG. 1, the front panel 16 of the cover 12 has an exterior surface that includes a display area 80 defined by a raised frame 82 having eight inwardly extending prongs 84 spaced from the front panel of the cover to define a gap for receiving suitably sized advertisement or promotional material (not shown) around its edges. The advertisement is preferably a lightweight cardstock or plastic insert with printed indicia on its front face. Flexing the advertisement slightly allows it to be is inserted underneath the prongs 84. The advertisement can be removed and replaced by another advertisement as needed according to the products near the sign 10.

An illustrative embodiment of the invention has been described in detail for the purpose of disclosing a practical, operative structure whereby the invention may be practiced advantageously. However, the apparatus described is intended to be illustrative only, and the novel characteristics of the invention may be incorporated in other structural forms without departing from the scope of the invention. For instance, the described embodiment is particularly suited for attachment to vertical surfaces, such as freezer doors and the like, however, a suitable mounting bracket could be affixed to the base to secure the sign to horizontal structures, such as shelving units. Moreover, the disclosed embodiment describes the moveable warning extension as an arm pivotally connected to the base, however, the extension could be other suitable structures attached by any movable means. As an example, the warning arm could be a folded or coiled structure. Accordingly, to apprise the public of the full scope of the invention, the following claims are made.

What is claimed is:

1. A hazard warning sign, comprising:

a housing having a base and a cover attached to the base to define a cavity when in a closed position and when in an open position at least one edge of the cover is separated from the base to reveal the interior of the cavity; and a warning extension mounted within the cavity and movable from a retracted position, wherein the warning extension is substantially parallel with the housing so as to be concealed by the housing when the housing is in the closed position to an extended position wherein the extension is at an angle to the housing when in the open position; further including an alarm disposed within the cavity.

2. The warning sign of claim 1, wherein the cover is hinged to the base along a bottom horizontal edge.

3. The warning sign of claim 2, wherein the cover further includes a pul tab at a free edge opposite the bottom edge.

4. The warning sign of claim 3, wherein the cover further includes a magnetic closure component at the free edge and wherein the base further includes a corresponding magnetic closure component mating with the magnetic closure component of the cover by magnetic attraction when the housing is in the closed position.

5. The warning sign of claim 1, wherein the base and the cover have respective back and front panels extending substantially horizontally.

6. The warning sign of claim 5, wherein the base has a first interior surface with a first warning indicium and the cover has a second interior surface with a second warning indicium.

a warning extension mounted within the cavity and movable from a retracted position substantially parallel with the housing so as to be concealed by the housing when in the closed position to an extended position at an angle to the housing when in the open position;

wherein the base and the cover have respective back and front panels extending substantially horizontally;

wherein the base has a first interior surface with a first warning indicium and the cover has a second interior surface with a second warning indicium;

wherein the first and second warning indicia are decals.

7. The warning sign of claim 5, wherein the warning extension can be held in a free state substantially perpendicular to the base of the housing when the housing is in the open position.

8. The warning sign of claim 5, wherein the cover further has an exterior surface defining a display region.

9. The warning sign of claim 1, wherein the warning extension is an elongated, horizontally-extending planar arm having opposite faces with warning indicia.

10. The warning sign of claim 9, wherein the arm is pivotally connected to the housing.

11. The warning sign of claim 1, wherein the alarm is a switch activated audio alarm.

12. The warning sign of claim 1, further including a mounting member.

13. A hazard warning sign, comprising:

a housing having a base and a cover attached to the base to define a cavity when in a dosed position and when in an open position at least one edge of the cover is separated from the base to reveal the interior of the cavity; and a warning extension mounted within the cavity and movable from a retracted position, wherein the warning extension is substantially parallel with the housing so as to be concealed by the housing when the housing is in the closed position to an extended position wherein the extension is at an angle to the housing when in the open position;

wherein the base and the cover have respective back and front panels extending substantially horizontally;

wherein the base has a first interior surface with a first warning indicium and the cover has a second interior surface with a second warning indicium;

wherein the first and second warning indicia are decals.

14. A hazard warning sign, comprising:

a housing having a base and a cover attached to the base to define a cavity when in a closed position and when in an open position at least one edge of the cover is separated from the base to reveal the interior of the cavity; and a warning extension mounted within the cavity and movable from a retracted position, wherein the warning extension is substantially parallel with the housing so as to be concealed by the housing when the housing is in the closed position to an extended position wherein the extension is at an angle to the housing when in the open position;

wherein the base and the cover have respective back and front panels extending substantially horizontally;

wherein the cover further has an exterior surface defining a display region;

wherein the display region includes a raised frame about its perimeter having a plurality of prongs defining a gap for receiving an advertisement.

15. A hazard warning sign, comprising:

a housing having a base and a cover attached to the base to define a cavity when in a closed position and when in an open position at least one edge of the cover is separated from the base to reveal the interior of the cavity; and a warning extension mounted within the cavity and movable from a retracted position, wherein the warning extension is substantially parallel with the housing so as to be concealed by the housing when the housing is in the closed position to an extended position wherein the extension is at an angle to the housing when in the open position;

a mounting member including one or more hook and loop fasteners affixed to an exterior surface of the base;

wherein the warning extension is adapted to extend along a line intersecting the base of the housing when the housing is in the open position.

16. A combination advertising and warning sign mountable to a display surface in a retail store for displaying promotional materials and warning of spills and other hazardous conditions, the sign comprising:

a housing having an exterior display surface for mounting the promotional material; and a movable warning arm having warning indicia and mounted within the housing so that it can be concealed by the housing and alternatively so that it extends away from the housing to reveal the warning indicia wherein the housing includes a cover hinged to a base so that the housing can be moved from a closed position in which the housing defines a cavity containing the warning arm to an open position in which interior surfaces of the cover and base are exposed;

further comprising warning indicia affixed to interior surfaces of the cover and base so as to be concealed when the housing is in the closed position and revealed when the housing is in the open position.

17. The combination advertising and warning sign of claim 16, wherein the warning arm is pivotally connected to the housing about a vertical axis.

18. The combination advertising and warning sign of claim 16, further comprising a switch-activated audio alarm disposed within the housing cavity.

* * * * *

UNITED STATES PATENT AND TRADEMARK OFFICE

CERTIFICATE OF CORRECTION

PATENT NO. : 6,854,203 B2 
DATED : February 15, 2005
INVENTOR(S) : Bruce R. Kern, Don Ladson and Lewis G. Libby It is certified that error appears in the above-identified patent and that said Letters Patent is hereby corrected as shown below:

Column 5,
Delete lines 28-38.

Signed and Sealed this

Tenth Day of May, 2005

JON W. DUDAS
*Director of the United States Patent and Trademark Office*